US006877499B1

(12) United States Patent
Otto

(10) Patent No.: US 6,877,499 B1
(45) Date of Patent: Apr. 12, 2005

(54) THROWING APPARATUS

(75) Inventor: Gary D. Otto, Pryor, OK (US)

(73) Assignee: Sports Vision, Inc., Pryor, OK (US)

( * ) Notice: Subject to any disclaimer, the term of this patent is extended or adjusted under 35 U.S.C. 154(b) by 0 days.

(21) Appl. No.: 10/755,652

(22) Filed: Jan. 13, 2004

(51) Int. Cl.[7] ..... F41B 3/00
(52) U.S. Cl. ..... 124/7; 124/16
(58) Field of Search ..... 124/7, 16, 26

(56) References Cited

U.S. PATENT DOCUMENTS

| | | | | | |
|---|---|---|---|---|---|
| 943,494 | A | * | 12/1909 | Venn et al. | 124/7 |
| 1,912,360 | A | * | 6/1933 | Blanchard | 124/7 |
| 3,788,297 | A | * | 1/1974 | Borst | 124/7 |
| 4,082,076 | A | * | 4/1978 | Perry | 124/7 |
| 4,860,717 | A | * | 8/1989 | Powell et al. | 124/7 |
| 4,906,001 | A | * | 3/1990 | Vaughn | 473/438 |
| 4,995,371 | A | * | 2/1991 | Kuizinas | 124/7 |
| 5,121,735 | A | * | 6/1992 | Hancock | 124/7 |
| 5,660,386 | A | * | 8/1997 | Krieger | 124/7 |
| 6,129,076 | A | * | 10/2000 | Powell et al. | 124/7 |
| 6,182,648 | B1 | * | 2/2001 | Lundgren | 124/7 |
| 6,546,923 | B1 | * | 4/2003 | Erickson | 124/16 |

* cited by examiner

*Primary Examiner*—John A. Ricci
(74) *Attorney, Agent, or Firm*—Frank L. Hart

(57) ABSTRACT

An apparatus for throwing an object is mechanically operated and utilizes spring tension to throw an object from a tube which is connected to the spring. The apparatus comprises a base, a frame, apparatus utilized for maintaining the frame at an operating position, a tube and at least one spring. An operator inserts an object to be thrown into the tube, manually moves the tube to a preselected cocked position against spring tension and then releases the tube.

18 Claims, 4 Drawing Sheets

THROWING APPARATUS

BACKGROUND OF THE INVENTION

1. Field of the Invention

The invention relates to an improved throwing apparatus. More particularly, this invention relates to an improved apparatus for throwing a ball.

2. Description of Related Art including information disclosed under 37 CFR 1.97

Both manual and electrically driven throwing apparatus are well known in the art. These apparatus are used for throwing footballs, baseballs, soft balls and are used for training individuals to catch and hit the balls.

An example of a prior art apparatus of this type is U.S. Pat. No. 6,129,076 "Throwing Apparatus and Method" which issued to Richard O. Powell and Bert L. Powell, Jr. on an application filed Apr. 9, 1999 and issued Oct. 10, 2000.

It is desirable to provide an apparatus for throwing balls that is mechanical, light weight, easy to operate, inexpensive to construct, and adjustable for delivering the ball in a preselected manner.

BRIEF SUMMARY OF THE INVENTION

In one aspect of the invention, an apparatus is provided for throwing an object. The apparatus has a base, a frame, maintaining means, a tube and at least one spring. The frame is pivotally connectable to an end portion of the base. The maintaining means holds the frame against pivotal movement of the frame relative to the base in an operational position of the apparatus. In the operational position of the apparatus, the frame extends outwardly from the base at an angle greater than ninety degrees. The tube has an opening sufficient for receiving an object to be thrown. The spring is connected at one end to the tube and at the other end to the frame.

In another aspect of the invention, an apparatus is provided for throwing an object. The apparatus has a base, a frame, a maintaining means, a flange, a tube, and at least one spring. The base has first and second end portions. The frame has a longitudinally extending centerline and first and second end portions. The frame first end portion is pivotally connectable to the first end portion of the base. The means maintains the frame against pivotal movement relative to he base at an operational position of the apparatus at which the frame extends outwardly from the base at an angle greater than ninety degrees. The flange has first and second end portion. The second end portion of the flange is angularly connectable to the second end portion of the fame with said flange first end portion being positioned a greater distance from the base than said flange second end portion at the operational position of the frame. The tube has first and second end portions and an opening extending therethrough. The tube opening is of a size sufficient to receive an object to be thrown. The spring has first and second end portions and is connectable at the first end portion of the tube and at the second end portion to the second end portion of the flange.

BRIEF DESCRIPTION OF THE SEVERAL VIEWS OF THE DRAWING(S)

DETAILED DESCRIPTION OF THE INVENTION

Figure 1:
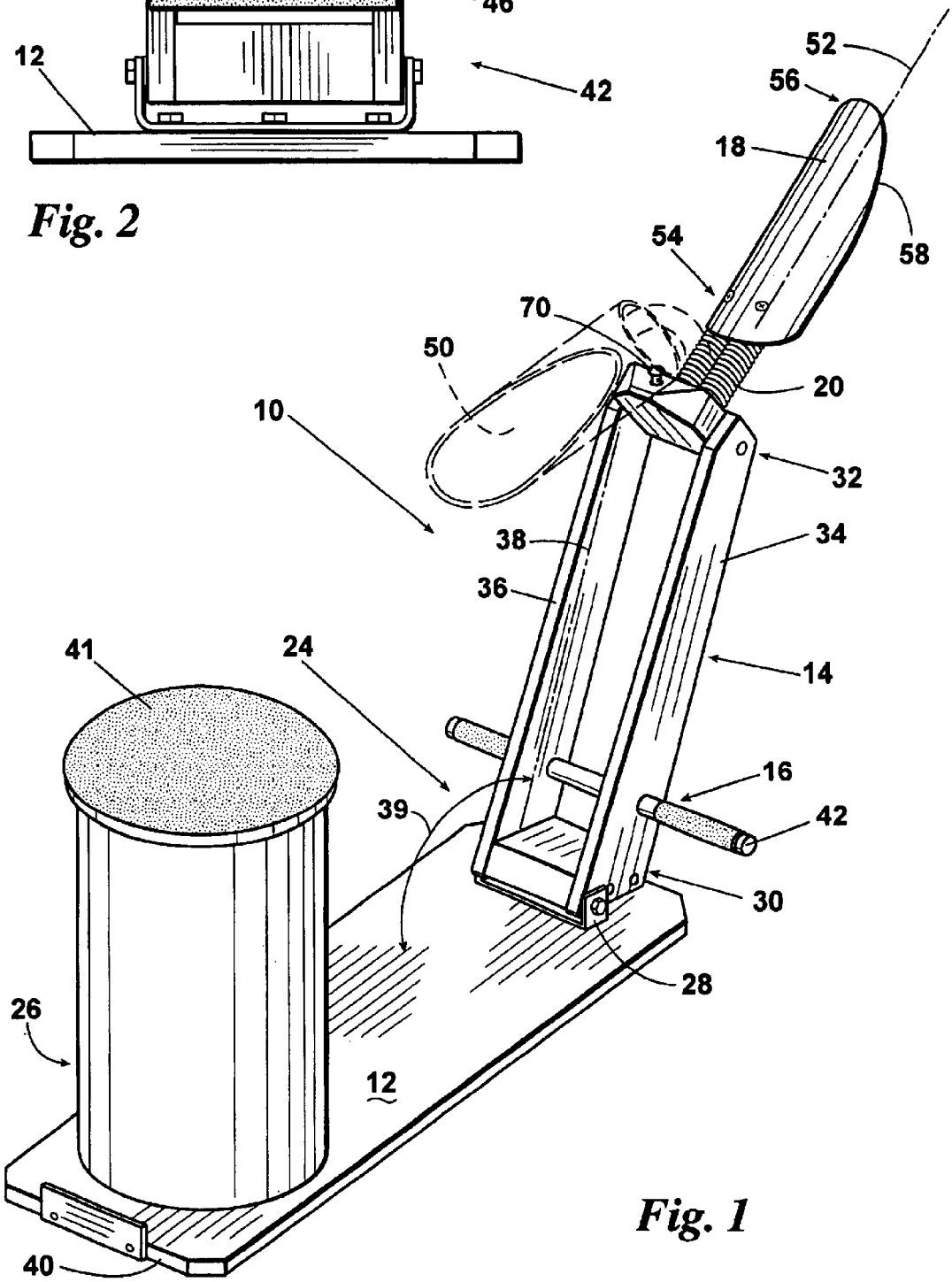
FIG. 1 is a perspective view of the apparatus of this invention.

Referring to FIG. 1, the apparatus of this invention 10 has a base 12, a frame 14, a maintaining means 16, a tube 18 for receiving an object to be thrown, and at least one spring 20.

The base 12 is preferably of general rectangular configuration having first and second end portions 24,26. The frame 14 has first and second end portions 30,32 is pivotally connectable via hardware 28 to the base first end portion 24. In the preferred construction shown in FIG. 1, the frame 14 is comprised of first and second spaced apart frame members 34, 36. The frame 14 has a longitudinally extending centerline 38 and extends outwardly from the base 12 at an angle 39 greater than ninety (90) degrees in the operational position of the apparatus 10. It should be understood that the frame 14 preferably comprises two spaced apart members 34,36, but can be constructed as a single member without departing from this invention. It should also be understood from a study of the drawings that the frame 14 is pivotally connectable to the base 12 at a location on the frame 14 wherein the frame 14 is spaced from the base 12 a preselected distance when the frame 14 is positioned perpendicular to the base 14. The width of the frame 14, the magnitude of the space between the frame 14 and the base 12, and the location of the frame connection along the frame width determine the angle of the frame 14 relative to the base 12 in the operating position of the apparatus 10, as shown in FIG. 1. That angle permits the back edge of the frame 14 to contact the base 12 in the operating position and thereby form a stop for the pivotal movement of the frame 14. This positioning of the pivotal connection can easily be determined by one skilled in the art without undue experimentation after selection of the preferred dimensions of the frame 14.

The angle of the frame 14 relative to the base 12 is greater than ninety (90) degrees in the operating position of the apparatus 10 in order to reduce the forces required to maintain the operating position during throwing operations. Preferably, that angle is about 110 degrees.

The base 12 has an end 40. The base 12 extends outwardly from the pivotal connection 28 of the frame 14 to the base 12 a distance sufficient for receiving a seat 41 for an operator. That distance preferably is at least twenty (20) inches. Distances shorter than 20 inches are undesirable because the operator would be cramped up and too close to comfortably operate the apparatus as hereinafter more fully described.

Means 16 is provided for maintaining the frame against pivotal movement relative to the base 12 during operation of the apparatus. In the preferred embodiment shown in FIG. 1, the means 16 is a foot rest 42 connectable to the frame 14 at a location spaced from the pivotal connection 28 of the frame 14 to the base 12. The foot rest 42 extends through the frame members 34, 36 and outwardly therefrom a distance sufficient for receiving the foot of an operator. Pressure from an operator's foot thereby prevents pivotal movement of the frame 14 toward the base end 40 during throwing operations.

Figure 2:
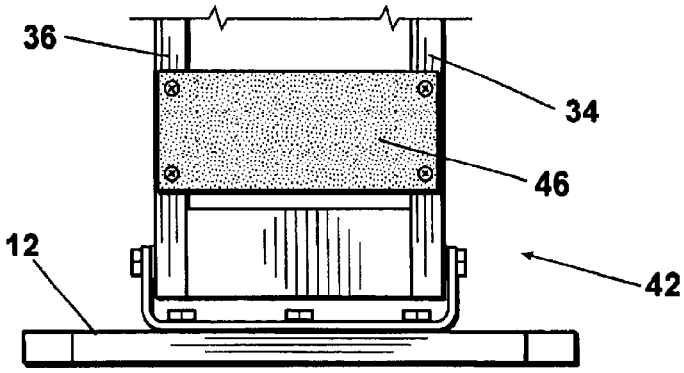
FIG. 2 is a frontal view of a portion of the apparatus of this invention showing another embodiment of the foot rest.
Figure 5:
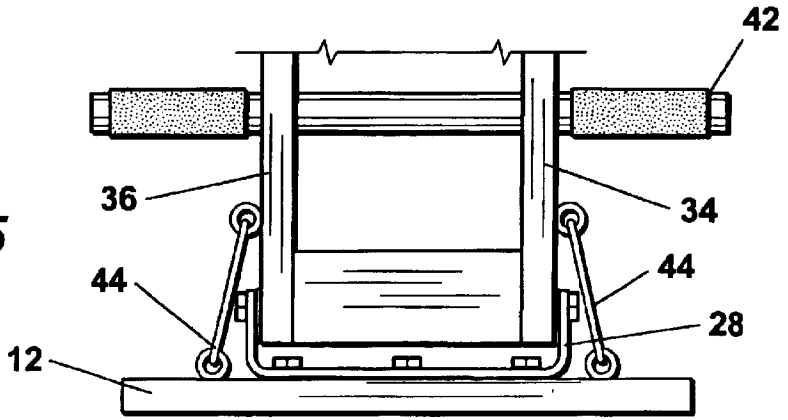
FIG. 5 is a frontal view of a portion of the apparatus of this invention showing a hook eye apparatus for maintaining the frame against pivotal movement.

In another embodiment, shown in FIG. 2, the foot rest is of different construction and consists of a plate 46 for receiving an operator's foot and is connectable to the first and second frame members 34,36 and spanning the distance therebetween. In yet another embodiment, shown in FIG. 5, the frame 14 is maintained against pivotal movement by a latching apparatus 44 such as a hook and eye, as are well known in the art.

A tube 18 has first and second end portions and a chamber or opening 50 of a size sufficient for receiving an object to be thrown. In the preferred embodiment and use of the apparatus, the object to be thrown is a ball. The tube 48 has a centerline 52 and first and second end portions 54,56. The second end 58 of the tube is angularly oriented relative to the tube centerline 52 (see FIG. 6), preferably at an angle of at least 25 degrees. The tube portion having the longest longitudinal length is oriented toward the end 40 and second end portion 26 of the base 12 in the mounted position.

Figure 4:
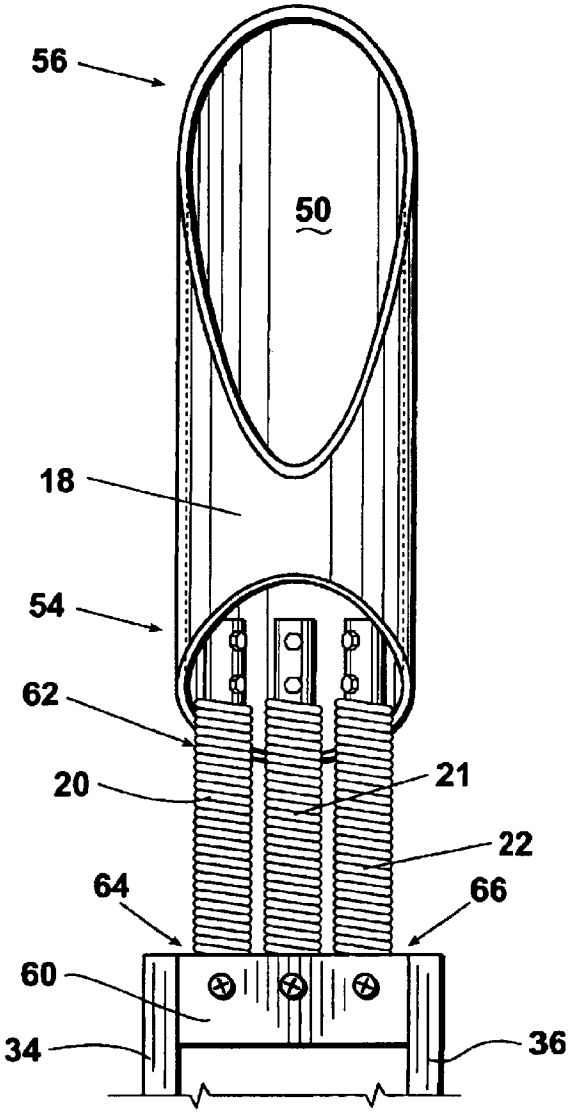
FIG. 4 is a rear view of a portion of the apparatus of this invention showing an embodiment having a plurality of springs.

The tube 48 is connectable to the frame 14 via at least one spring 20 and a flange 60. In the preferred embodiment, the tube 48 is connectable to the frame by two or more springs 20, 21, 22,(see FIG. 4) more preferably, by two coil springs 20,22. Each spring has first and second end portions 62,64, said spring first end portion 62 being connectable to the first end portion 54 of the tube 18 and said spring second end portion 64 being connectable to the frame 14 via the second end portion 68 of the flange 60.

Figure 3:
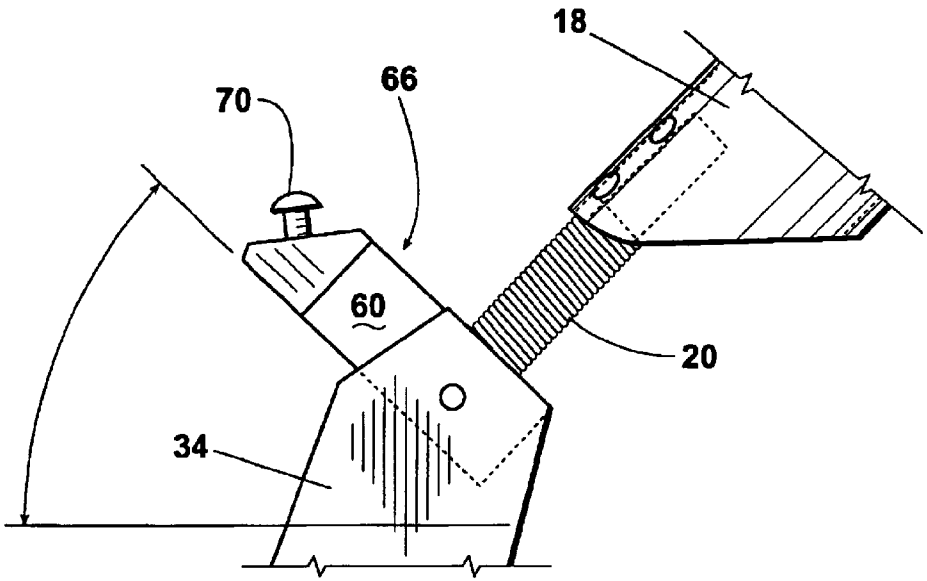
FIG. 3 is a side view of a portion of the apparatus of this invention showing the flange which connects the spring to the frame.

Referring to FIG. 3, the flange 60 has first and second end portions 66,68 and is utilized for connecting the spring and associated tube 18 to the frame 14. The flange 60 is angularly connectable to the second end portion of the frame 32 with said flange first end portion being positioned a greater distance from the base than said flange second end portion 68 in the operating position of the apparatus as shown in FIG. 1. The second end portion 64 of the spring 20, or springs 20–22, is connectable to the second end portion 68 of the flange 60. The first end portion 68 of the flange 60 is connectable to the frame 14. The flange 60 is preferably angled relative to the centerline 38 of the frame 14 a magnitude of about 25 degrees, as stated above.

Figure 7:
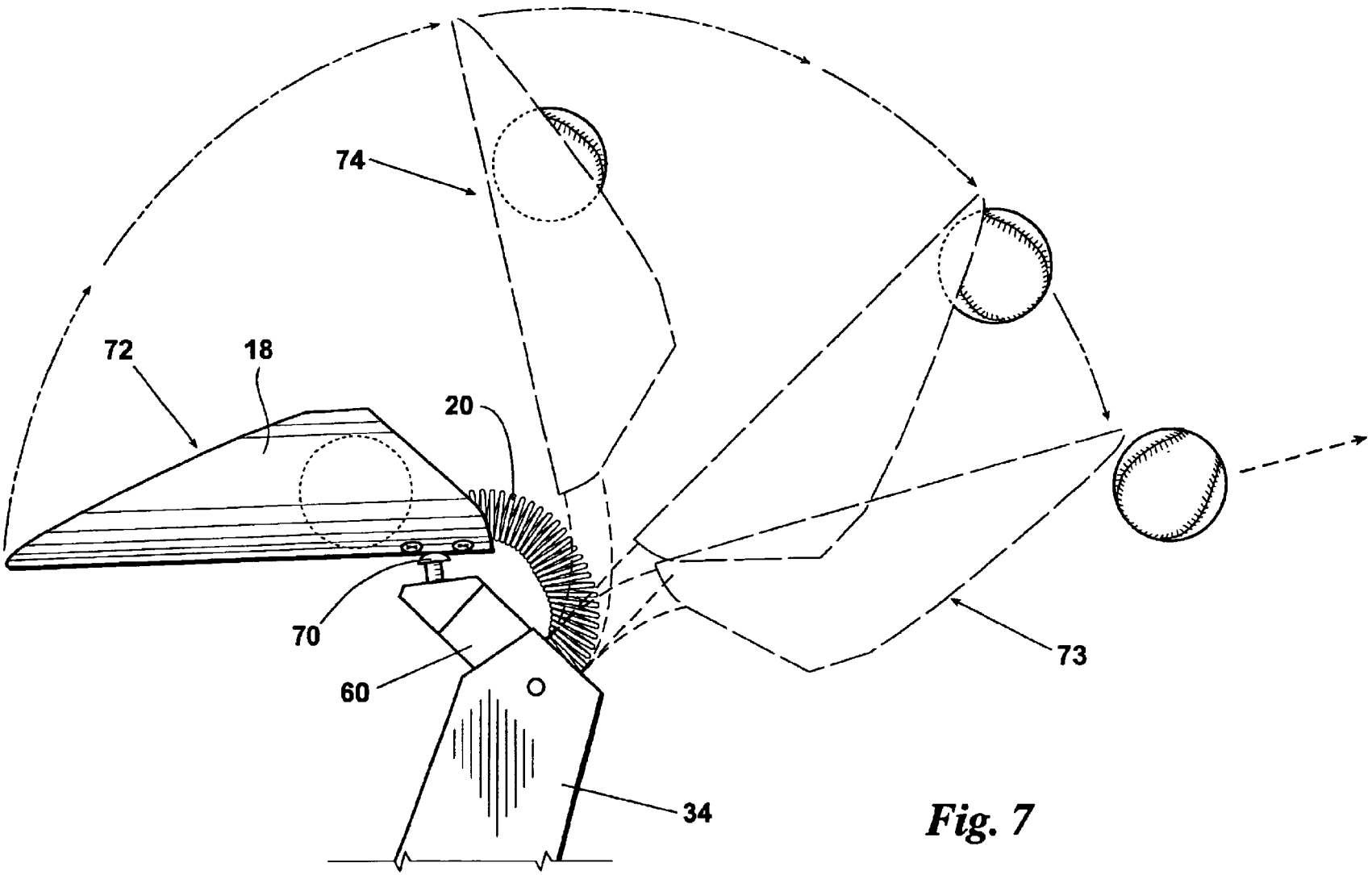
FIG. 7 is a partial side view of the apparatus of this invention showing the positions of movement of the throwing tube.

In the operation of the apparatus 10 and operator sits on the seat 41 and places his feet on the maintaining means 16 or locks the frame 14 in the operating position of the frame 14, as shown in FIG. 1. The operator places an object to be thrown into the chamber or opening 50 of the tube 18, grasps the second end portion 56 of the tube 18 and moves the tube in a direction toward the end 40 of the base 12 and to the cocked position of the tube 18 in contact with a stop 70. The stop 70 is connectable to the first end portion of the flange 60 and is adjustable in height. The operator then releases the tube 18 and the spring tension causes the tube 18 to move to the throwing position and discharge the object to be thrown from the tube 18. The tube then returns to the rest position. FIG. 7 shows the cocked 72, throwing 73, and rest 74 positions of the tube 18. The stop 70 is moveable to a multiplicity of different elevations to change the configuration of the flight path of the object thrown. The stop 70, preferably is a threaded screw connectable to the flange 60.

Figure 6:
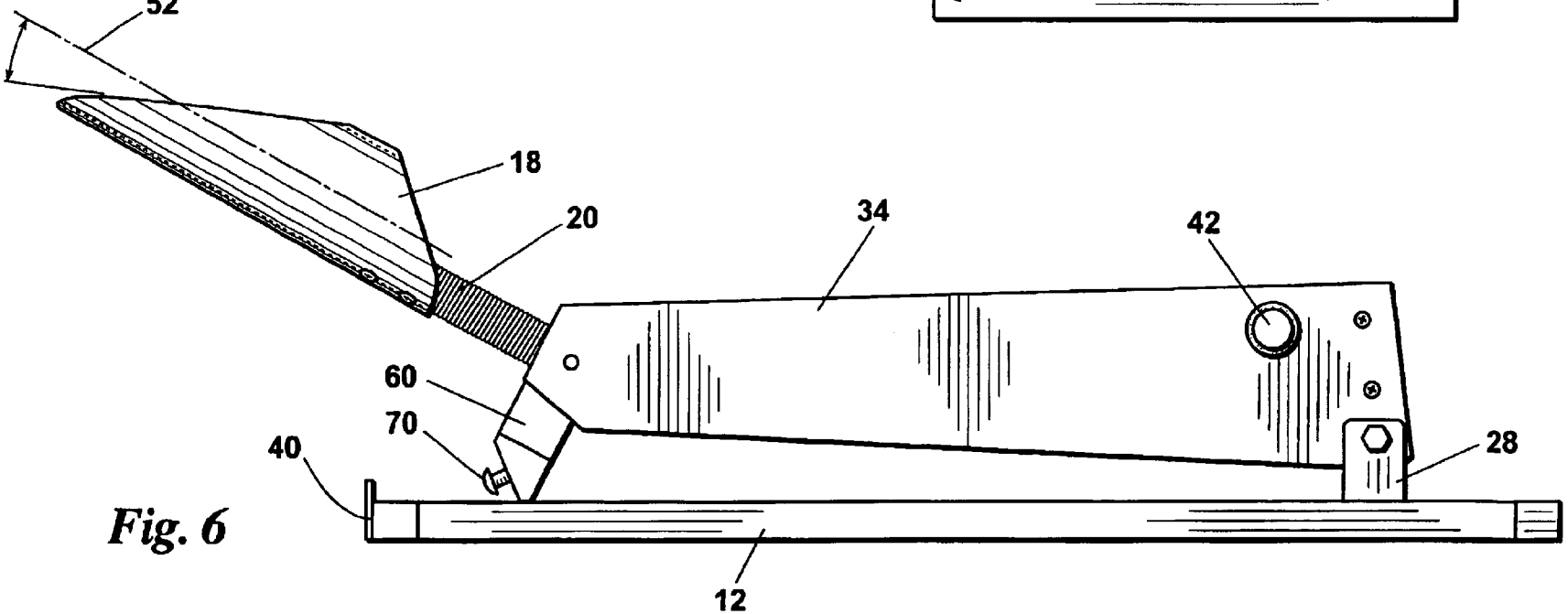
FIG. 6 is a side view of the apparatus of this invention in a transporting position.

It should be understood that the various elements set forth herein can be separate and connectable one to the other in the unassembled condition when the apparatus of this invention is delivered in kit form which contains a bucket seat, a ball bucket within the bucket seat, and a carrying strap for ease in transporting the apparatus. The elements are assembled and connected in the operating condition. FIG. 6 shows the apparatus in the transporting position wherein the frame is pivoted to a position immediately adjacent the base.

Other, object and advantages of the invention can be obtained by a study of the specification, the drawings and the appended claims.

What is claimed is:

1. An apparatus for throwing an object, comprising:

a base;

a frame pivotally connectable to an end portion of the base;

means for maintaining the frame against pivotal movement of the frame relative to the base in an operational position of the apparatus at which the frame extends outwardly from the base at an angle greater than ninety (90) degrees;

a tube having an opening sufficient for receiving an object to be thrown; and at least one spring having first and second ends, said first end being connected to the tube and said second end connected to the frame.

2. An apparatus, as set forth in claim 1, wherein the connection of the spring to the frame includes a flange positioned between and connected to the spring and the frame.

3. An apparatus, as set forth in claim 2, wherein the maintaining means of the frame includes a foot rest connected to the frame at a location spaced from the pivotal connection of the frame to the base.

4. An apparatus, as set forth in claim 1, wherein there are two coil springs each connected at one end to the tube and at the other end to the frame.

5. An apparatus for throwing an object, comprising:

a base having first and second end portions;

a frame having a longitudinally extending centerline and first and second end portions, said frame first end portion being pivotally connectable to the first end portion of the base;

means for maintaining the frame against pivotal movement relative to the base at an operational position of the apparatus at which the frame extends outwardly from the base at an angle greater than ninety (90) degrees;

a flange having first and second end portions, said second end portion of the flange being angularly connectable to the second end portion of the frame with said flange first end portion being positioned a greater distance from the base than said flange second end portion at the operational position of the frame in the operating position of the apparatus;

a tube having first and second end portions and an opening extending therethrough, said opening being of a size sufficient to receive an object to be thrown; and at least one spring having first and second ends and being connectable at the first end to the first end portion of the tube and at the second end to the second end portion of the flange.

6. An apparatus, as set forth in claim 5, wherein the maintaining means is a foot rest bar extending through the first end portion of the frame at a location spaced from the connection of the frame to the base.

7. An apparatus, as set forth in claim 6, wherein the frame includes first and second spaced apart frame members and the foot rest extends through the frame members and outwardly from opposed sides of the frame members a distance sufficient for receiving an operator's foot.

8. An apparatus, as set forth in claim 6, wherein the frame includes first and second spaced apart frame members and the foot rest is a plate connectable to and extending across the space between the frame members.

9. An apparatus, as set forth in claim 5, wherein there are a plurality of springs.

10. An apparatus, as set forth in claim 9, wherein there are two coil springs.

11. An apparatus, as set forth in claim 5, wherein the tube has a center line and the second end of the tube is angularly oriented relative to the centerline.

12. An apparatus, as set forth in claim 11, wherein the angle of the second end of the tube relative to the tube centerline is at least 25 degrees.

13. An apparatus, as set forth in claim 11, wherein the tube portion having the greatest longitudinal length is oriented toward the second end portion of the base.

14. An apparatus, as set forth in claim 5, wherein the tube is moveable responsive to flexing of the spring between an at rest position extending outwardly from the flange and a cocked position at which the tube is immediately adjacent the first end portion of the flange and including an adjustable stop connectable to the first end portion of the flange at a location in the pathway of tube during movement of the tube to the flexed position.

15. An apparatus, as set forth in claim 5, wherein the base extends outwardly from the frame a distance sufficient for receiving a seat for an operator.

16. An apparatus, as set forth in claim 15, wherein the base extends outwardly from the pivotal connection of the frame to the base a distance of at least 20 inches.

17. An apparatus, as set forth in claim 5, wherein the object to be thrown is a ball.

18. An apparatus, as set forth in claim 5, wherein the frame is pivotally moveable between a stored position at which the frame is extending along and contacting the base and the operational position.

* * * * *